US008991467B2

(12) United States Patent
Ashelin et al.

(10) Patent No.: US 8,991,467 B2
(45) Date of Patent: Mar. 31, 2015

(54) FLEXIBLE ROOM DIVIDERS

(75) Inventors: Charles J. Ashelin, Dubuque, IA (US); David J. Hoffmann, Peosta, IA (US); Matt Fleckenstein, Elmhurst, IA (US); Gregory J. Thill, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 239 days.

(21) Appl. No.: 12/840,911

(22) Filed: Jul. 21, 2010

(65) Prior Publication Data

US 2012/0018103 A1 Jan. 26, 2012

(51) Int. Cl.

| | |
|---|---|
| ***E06B 9/24*** | (2006.01) |
| ***A62C 2/10*** | (2006.01) |
| ***A47H 21/00*** | (2006.01) |
| ***E04B 2/72*** | (2006.01) |

(52) U.S. Cl.

CPC *A62C 2/10* (2013.01); *A47H 21/00* (2013.01); *E04B 2/72* (2013.01)

USPC ..... 160/113; 52/404.1

(58) Field of Classification Search

CPC ..... E06B 2009/2458; E06B 5/00; E06B 5/16; A47H 23/02; A47H 23/04; A47H 2023/00; A47H 2023/02; A47H 2023/025; A47H 21/00; A47K 3/38; A47G 5/04

USPC ..... 160/115, 123, 126, 330; 52/404.1, 52/404.4, 406.1, 407.1

See application file for complete search history.

(56) References Cited

U.S. PATENT DOCUMENTS

| | | | |
|---|---|---|---|
| 1,890,906 | A | 12/1932 | Harney |
| 2,720,269 | A | 10/1955 | Diacos |
| 2,911,038 | A * | 11/1959 | Frommelt ..... 160/351 |

(Continued)

FOREIGN PATENT DOCUMENTS

| | | |
|---|---|---|
| EP | 1559449 | 8/2005 |
| EP | 2065076 | 6/2009 |
| WO | 2005105218 | 11/2005 |

OTHER PUBLICATIONS

Gypsum Association "Fire Resistance Design Manual". 2009. Accessed Sep. 12, 2014 <https://law.resource.org/pub/us/code/bsc.ca.gov/sibr/org.gypsum.GA-600-09.pdf>.*

(Continued)

*Primary Examiner* — Katherine Mitchell
*Assistant Examiner* — Johnnie A Shablack
(74) *Attorney, Agent, or Firm* — Hanley, Flight & Zimmerman, LLC

(57) ABSTRACT

Example room dividers are described herein. The example room dividers include a flexible curtain with features pertaining to security, impactability, insulation, sound absorption, configurability, and/or flame resistance. In some examples, the curtain comprises an inorganic carbon fiber pad sandwiched between two sheets of fiberglass fabric coated with silicone rubber. A tongue-and-groove joint, in some examples, enables the interconnection of a series of curtains to create room dividers of various lengths. In some examples, the curtain comprises a full-width wire mesh sandwiched between two sheets of vinyl coated polyester fabric, wherein a touch-and-hold fastener at the outer perimeter of the curtain and overlapping the wire mesh holds the two sheets together and holds the wire mesh in place. In some examples, the flexibility of the curtain allows the curtain to respond to impacts and/or air pressure differentials.

25 Claims, 7 Drawing Sheets

(56) References Cited

U.S. PATENT DOCUMENTS

| | | | | |
|---|---|---|---|---|
| 3,261,024 | A * | 7/1966 | Delaney | 2/74 |
| 3,304,680 | A * | 2/1967 | Birdwell | 52/332 |
| 3,474,584 | A * | 10/1969 | Lynch | 52/309.13 |
| 3,913,292 | A | 10/1975 | Braekkan | |
| 4,175,481 | A * | 11/1979 | Burgess, Jr. | 454/170 |
| 4,437,505 | A * | 3/1984 | Rodgers | 160/126 |
| 4,635,422 | A * | 1/1987 | Nowack et al. | 52/406.1 |
| 4,833,855 | A * | 5/1989 | Winter, IV | 52/591.4 |
| 4,896,471 | A * | 1/1990 | Turner | 52/455 |
| 4,907,383 | A * | 3/1990 | Winter, IV | 52/86 |
| 5,425,210 | A * | 6/1995 | Zafir | 52/404.4 |
| 5,481,834 | A * | 1/1996 | Kowalczyk et al. | 52/64 |
| 5,490,567 | A * | 2/1996 | Speer | 169/50 |
| RE37,139 | E * | 4/2001 | Krickl | 428/113 |
| 6,358,591 | B1 | 3/2002 | Smith | |
| 7,018,699 | B2 * | 3/2006 | Dykhoff | 428/76 |
| 7,351,459 | B2 * | 4/2008 | Fay et al. | 428/43 |
| 7,381,456 | B2 * | 6/2008 | Fay et al. | 428/36.9 |
| 7,395,869 | B2 * | 7/2008 | Schnabel et al. | 169/48 |
| 7,767,597 | B2 | 8/2010 | Garvey | |
| 7,883,056 | B2 | 2/2011 | Mueller et al. | |
| 8,062,985 | B2 | 11/2011 | Collier et al. | |
| 2008/0001128 | A1 | 1/2008 | Goldberg | |
| 2008/0063875 | A1 * | 3/2008 | Robinson et al. | 428/426 |
| 2009/0140097 | A1 | 6/2009 | Collier et al. | |
| 2010/0051210 | A1 * | 3/2010 | Daly | 160/113 |
| 2011/0088918 | A1 | 4/2011 | Gonzales | |
| 2013/0098567 | A1 * | 4/2013 | Ashelin et al. | 160/330 |

OTHER PUBLICATIONS

Structural Board Association "OSB Performance by Design". 2005. Accessed Sep. 12, 2014 <http://osbguide.tecotested.com/pdfs/en/tm420.pdf>.*

European Patent Office, "Communication Pursuant to Rules 161(1) and 162 EPC," issued in connection with European Patent Application No. 11728123.8-1604, mailed on Mar. 5, 2013. (2 pages).

European Patent Office, "Communication Pursuant to Article 94(3) EPC," issued in connection with European Patent Application No. 11728123.8-1604, mailed on Oct. 29, 2013. (7 pages).

International Bureau, "International Preliminary Report on Patentability," issued in connection with international application serial No. PCT/US2011/040303, mailed Jan. 31, 2013, 11 pages.

International Searching Authority, "Search Report," issued in connection with international application serial No. PCT/US2011/040303, mailed Feb. 20, 2012, 6 pages.

International Searching Authority, "Written Opinion of the International Searching Authority," issued in connection with international application serial No. PCT/US2011/040303, mailed Feb. 20, 2012, 10 pages.

* cited by examiner

FIG. 3
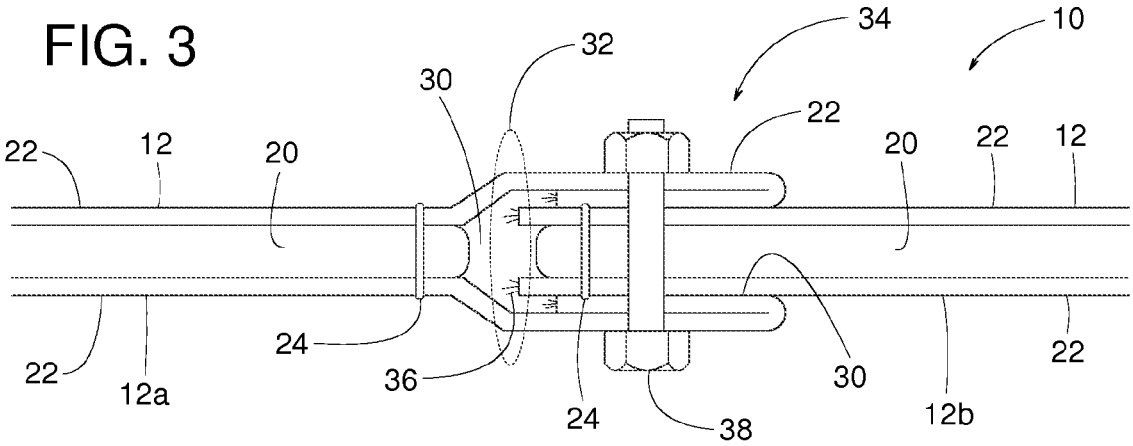
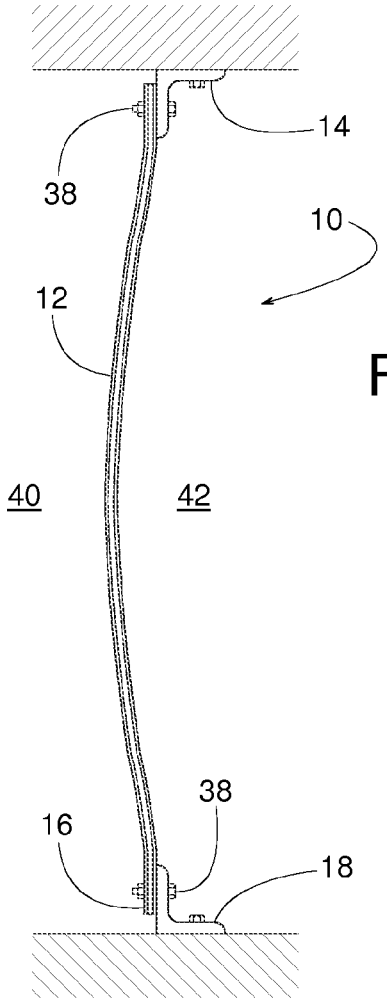
FIG. 4

FLEXIBLE ROOM DIVIDERS

FIELD OF THE DISCLOSURE

This patent generally pertains to demising walls and, more specifically, to flexible room dividers.

BACKGROUND

A demising wall is an interior wall usually dividing one leased portion of a building from another. Although such walls may not be as permanent as the building's exterior walls, demising walls preferably are sturdy for security and other reasons and also often have insulating characteristics. The sturdiness of the wall, however, can make the wall expensive to erect and difficult to reposition or modify later to meet changing needs of the tenants.

BRIEF DESCRIPTION OF THE DRAWINGS

FIG. 3 is a cross-sectional view taken along line 3-3 of FIG. 2.

FIG. 4 is an end view of the curtain of FIG. 1 suspended from an overhead support.

DETAILED DESCRIPTION

Figure 1:
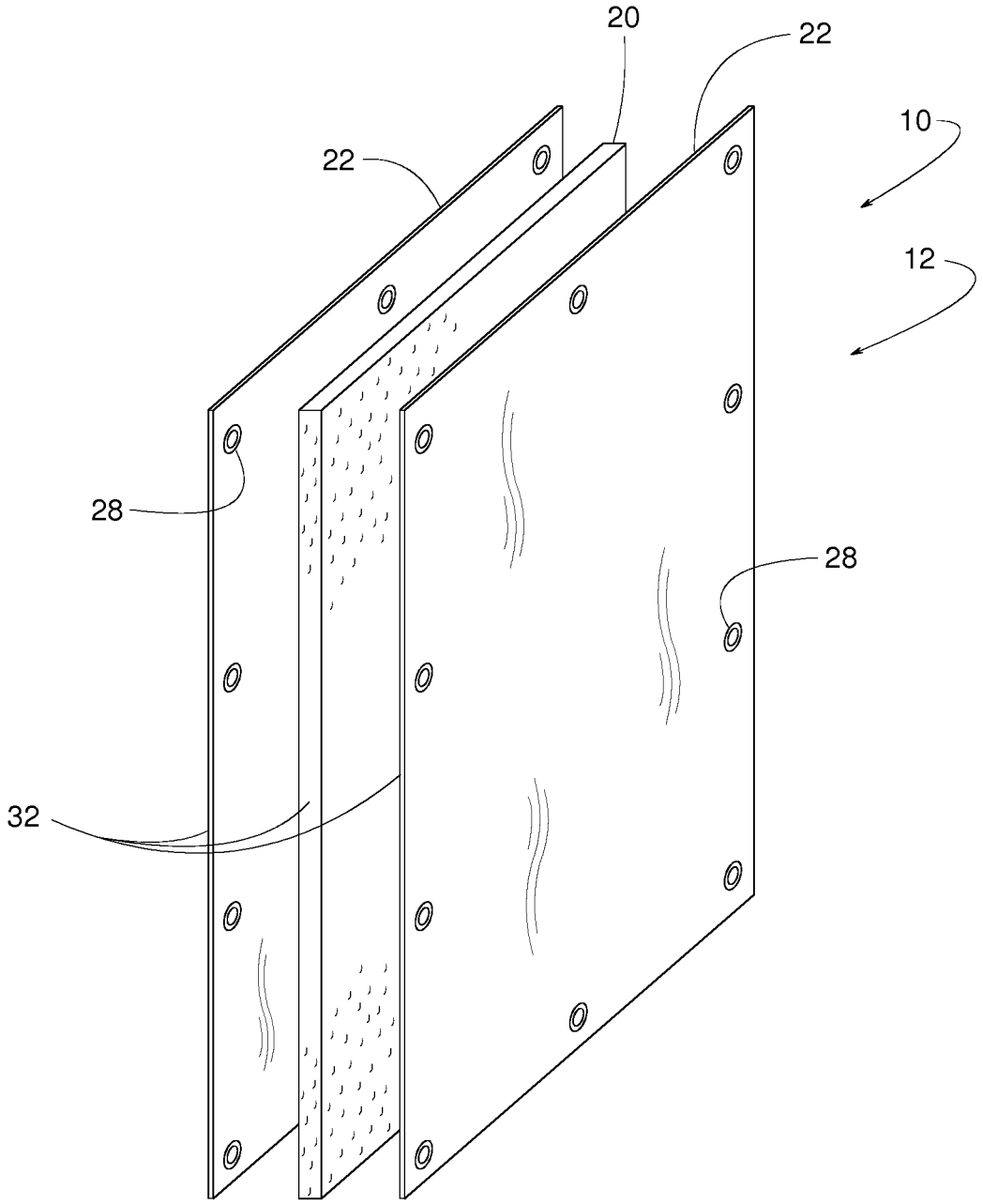
FIG. 1 is an exploded view of an example curtain of an example room divider described herein.

FIGS. 1-4 show an example room divider 10 having one or more interconnectable, interlockable curtains 12 for separating two areas of a room. In other words, one or more curtains 12 can be interlocked, integrated or coupled together to define the room divider 10. In some examples, curtains 12 are suspended from an overhead structure 14, such as a ceiling, a rafter, a beam, a cable, etc. A lower end 16 of curtains 12, in some examples, is attached or coupled to a floor-mounted anchor 18, such as a structural angle iron, taut horizontal cable, eyebolt, etc.

For some applications, a room divider must have certain insulating characteristics (e.g., an R-value of at least 2) but must also be flame resistant. Traditional flexible insulated curtains use organic polymer components (e.g., polyester, PVC, polyethylene, etc.) for both the outer sheets and insulating material because the construction provides a curtain that is flexible, relatively easy to manufacture, simple and inexpensive to install, and with moderate insulating characteristics. However, these traditional insulated curtains are not flame resistant and are, therefore, excluded from applications where a fire-rated wall or barrier is required.

Some examples of room divider 10 are flame resistant, which makes such dividers particularly suited for use in areas subject to certain fire safety codes or regulations. The expression, "flame resistant," means the curtain is of a material that generally fails to burn or ignite even when exposed to an open flame.

In some examples, each curtain 12 includes an insulation pad 20 (e.g., matting, sheet, blanket, etc.) sandwiched or disposed between a pair of outer sheets 22. Pad 20, in some examples, includes an inorganic carbon fiber, wherein the expression, "inorganic carbon fiber" means the carbon therein is a mineral rather than derived from an organism or animal source. One example of pad 20 includes, but is not limited to, PYRON, which is a registered trademark of Zoltek Companies, Inc. of Bridgeton, Mo. Each outer sheet 22, in some examples, includes a flame resistant fiberglass fabric with a silicone rubber coating. One example of sheet 22 is a silver silica fabric provided by Alpha Associates, Inc. of Lakewood, N.J. In some examples, insulation pad 20 is less dense than the sheets 22.

Figure 2:
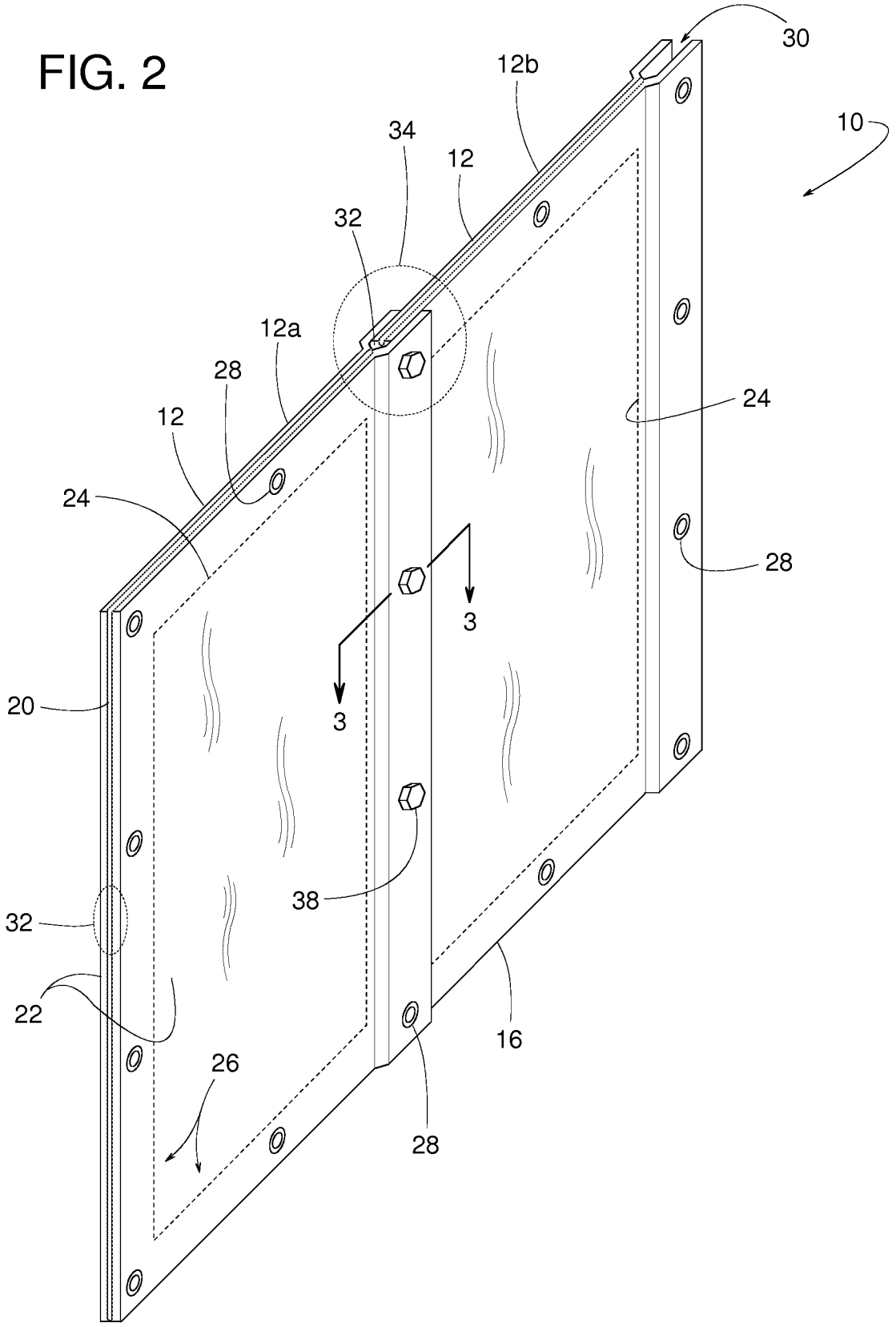
FIG. 2 is a perspective view of two example curtains of FIG. 1 connected to each other.
Figure 5:
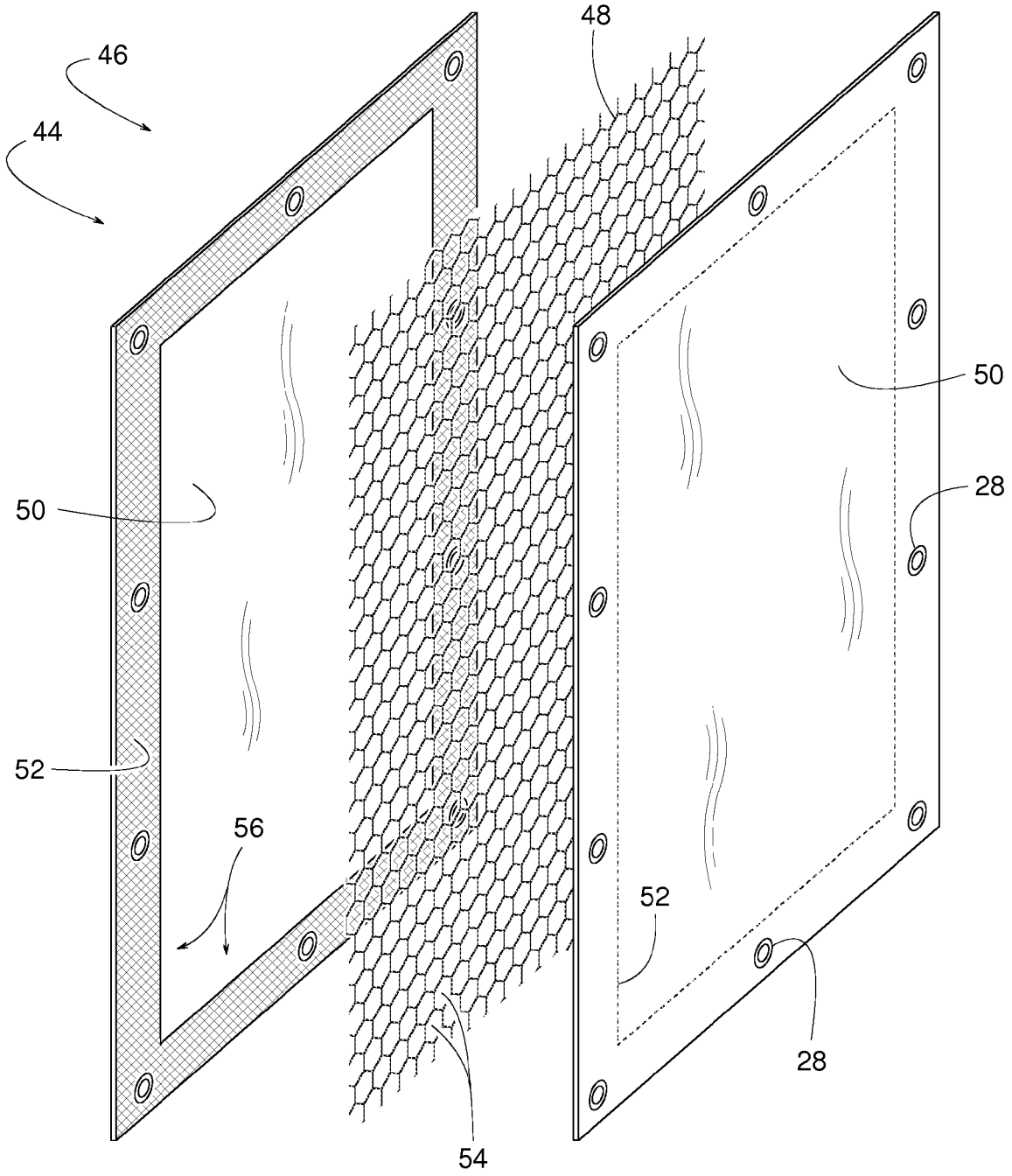
FIG. 5 is an exploded view of another example curtain described herein.

Although the actual construction of curtain 12 may vary, in some examples, a sewn seam 24 along an outer perimeter 26 of curtain 12 connects or couples pad 20 and sheets 22. Additionally or alternatively, a plurality of grommets 28 are disposed around perimeter 26 to help hold curtain 12 together. Grommets 28 also enable connecting one sheet 22 to another, and/or to connect sheet 22 to overhead structure 14 and/or to anchor 18. In the illustrated example, at least one edge or side of sheets 22 are wider or larger than pad 20 so that the edge or side of sheets 22 extend beyond pad 20 to create a groove 30 between sheets 22, as shown in FIGS. 2 and 3.

In some examples, to connect a second curtain 12*b* and a first curtain 12*a* (wherein curtains 12*a* and 12*b* are substantially identical to curtain 12 of FIG. 1), a tongue edge 32 of second curtain 12*b* is inserted or disposed in groove 30 of first curtain 12*a*, thereby creating a tongue-and-groove joint or connection 34 between curtains 12*a* and 12*b*. In examples where curtain 12 has one or more frayed edges 36 (e.g., due to the fiberglass fibers in sheet 22), tongue-and-groove joint 34 effectively covers or contains the exposed fibers, as shown in FIG. 3. Tongue-and-groove joint 34 ensures that connected curtains 12*a* and 12*b* overlap, which inhibits a fire from breaching room divider 10 through an otherwise non-overlapping joint. In some examples, a plurality of fasteners 38 (e.g., screws, bolts, buttons, snaps, ratchet-style ties, etc.) extend through grommets 28 and/or tongue-and-groove 34 to help hold curtains 12*a* and 12*b* together.

When room divider 10 is suspended between overhead structure 14 and anchor 18, as shown in FIG. 4, curtain 12, in some examples, is sufficiently flexible to balloon, bend, deflect, or puff out in response to an air pressure differential between areas 40 and 42. Such deflection can provide firefighters with insight as to the best way to deal with a fire that might respond positively or negatively to maintaining or relieving the pressure differential.

Although room divider 10 is described primarily for use in separating, or dividing, two areas of a room, room divider 10 may also be used to create three or four-sided structures within a larger room. In this manner, room divider 10 can be used to partition off a room within a room.

In another example, shown in FIGS. 5-8, a room divider 44 includes one or more interconnectable flexible curtains 46 that are not necessarily flame resistant; however, divider 44 is particularly useful as a security barrier partitioning two areas 40 and 42 of a room. In this example, each curtain 46 includes a wire mesh 48 sandwiched or disposed between a pair of flexible outer sheets 50. The expression, "wire mesh," means a porous flexible structure composed of, for example, a metal sheet or any other suitable material. Examples of wire mesh 48 include, but are not limited to, chain link fencing, metal screen, metal fabric, chain mail type fabric, cloth fabric with interwoven metal fibers, plastic sheet impregnated with metal fibers, metal netting, poultry netting, chicken wire, etc.

Each outer sheet 50, in this example, includes a flexible vinyl coated polyester fabric. Additionally or alternatively, outer sheet 50 includes a mass-loaded vinyl that improves the sound dampening characteristics of curtain 46. Examples of mass-loaded vinyl are offered by Super Soundproofing Company of San Marcos, Calif. In other examples, sheet 50 includes a flame resistant material similar or identical to sheet 22 of divider 10.

Figure 6:
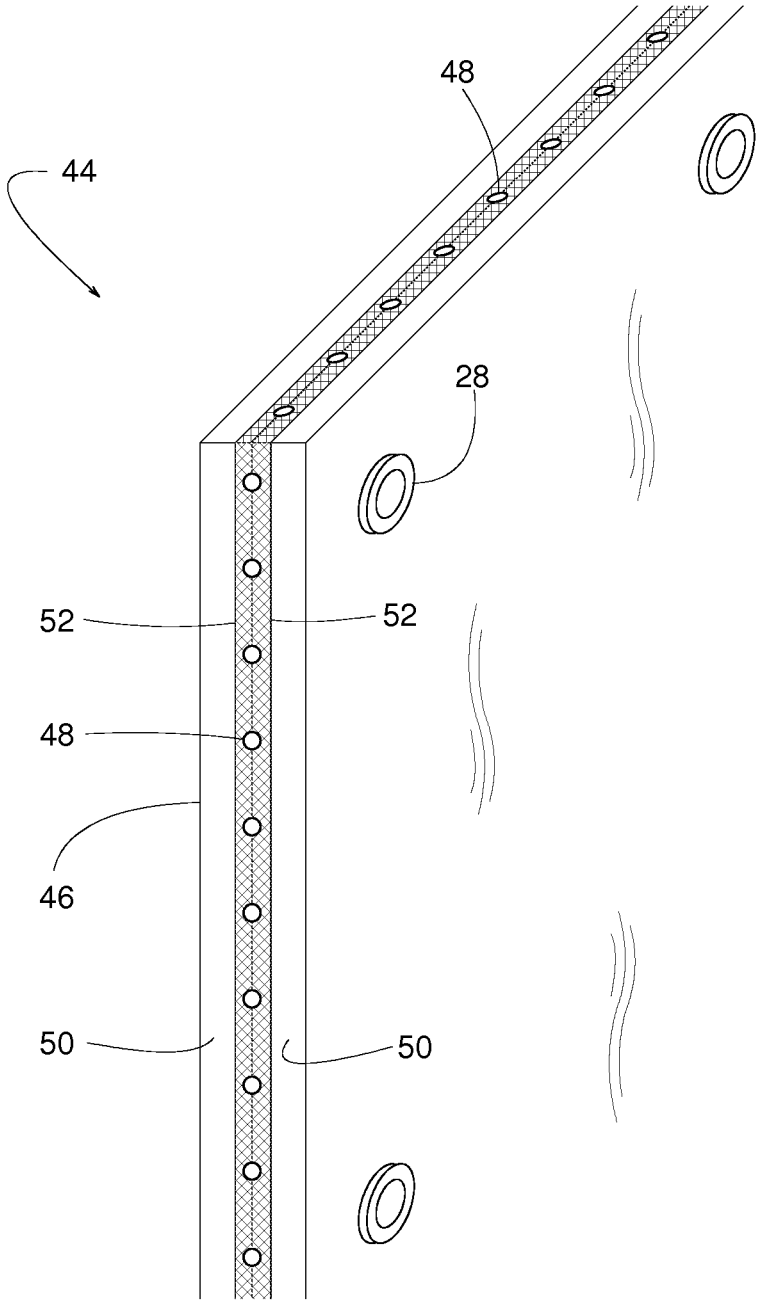
FIG. 6 is a perspective view of the curtain of FIG. 5 but showing the curtain in an assembled state.

In the illustrated example, a touch-and-hold fastener 52 (e.g., VELCRO—a registered trademark of Velcro Co. of Manchester, N.H.) with mating hook-and-loop halves disposed around an outer perimeter 56 of sheets 50 not only holds two sheets 50 to each other but also holds wire mesh 48 in place or position. Wire mesh 48, in this example, includes a plurality of hexagonal openings 54 through which the hooks and/or loops of touch-and-hold fastener 52 extend, thereby firmly holding wire mesh 48 between sheets 50, as shown in FIG. 6.

Figure 7:
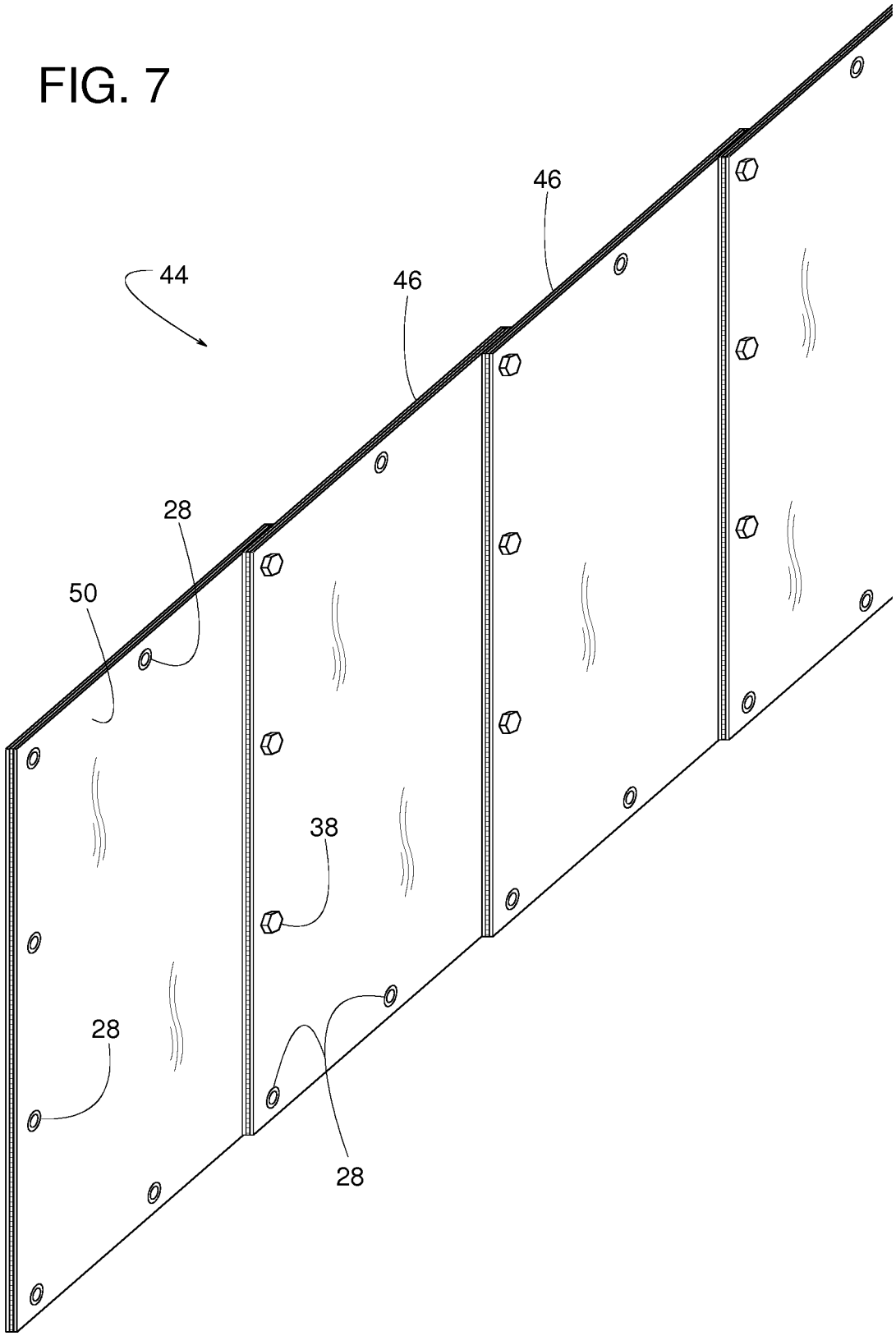
FIG. 7 is a perspective view of a plurality of curtains shown in FIGS. 5 and 6 that are coupled to form an example room divider or structure described herein.

Additionally or alternatively, a plurality of grommets 28 are disposed around perimeter 56 to help hold curtain 46 together. Grommets 28 also enable connecting one sheet 50 to another, and/or to connect curtain 46 to overhead structure 14 and/or to anchor 18. FIG. 7, for example, shows fasteners 38 extending through grommets 28 to interconnect a plurality of curtains 46.

Figure 8:
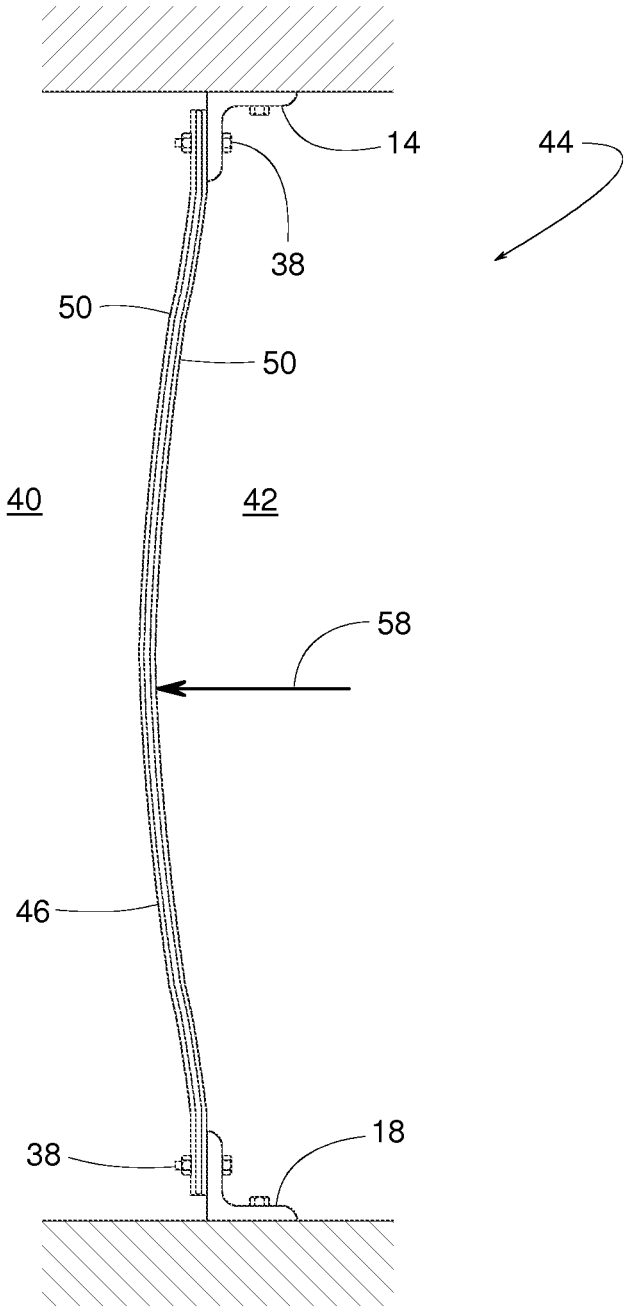
FIG. 8 is an end view similar to FIG. 4 but showing the curtain example of FIGS. 5-7.

FIG. 8 shows fasteners 38 extending through grommets 28 to suspend one or more curtains 46 between overhead structure 14 and floor-mounted anchor 18. In some examples, curtain 46 is sufficiently flexible to restorably deflect in response to an impact 58 such as, for example, the impact of a forklift accidentally striking curtain 46.

Although room divider 44 is described primarily for use in separating, or dividing, two areas of a room, room divider 44 may also be used to create three or four-sided structures within a larger room. In this manner, room divider 44 can be used to partition off a room within a room.

Some of the aforementioned examples may include one or more features and/or benefits including, but not limited to, the following:

Some example room dividers resiliently withstand an impact, provide a flame resistant barrier between areas, provide a visual barrier between areas, provide a physical partition that is relatively lightweight yet tamper-resistant for security, are easy to install and reconfigure, provide sound dampening, and/or react to air pressure for assisting firefighters in certain situations.

Some example room dividers include a full-width wire mesh secured between mating halves of a touch-and-hold fastener.

Some example room dividers include curtains with flexible sheets held together with both a touch-and-hold fastener and a series of grommets.

Some example room dividers include one or more curtains comprising an inorganic carbon fiber pad sandwiched between two sheets of fiberglass cloth fabric coated with silicone rubber.

Some example room dividers comprise a plurality of flexible curtains interconnected by tongue-and-groove joints.

Some example room dividers include one or more flexible curtains hanging suspended from and overhead structure with a lower edge of the curtains anchored to the floor.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A flame resistant room divider for an area that includes an overhead structure, the flame resistant room divider comprising:

a first flexible curtain having a first insulation pad disposed between a first outer sheet and a second outer sheet, each of the first and second outer sheets to extend beyond a first edge of the first insulation pad along one side of the first flexible curtain such that a first inner surface of the first outer sheet opposing a second inner surface of the second outer sheet extending beyond the first edge of the first insulation pad define a first groove; and a second flexible curtain having a second insulation pad disposed between a third outer sheet and a fourth outer sheet, a first outer surface of the third outer sheet, a second outer surface of the fourth outer sheet, and a first edge of the second insulation pad to define a tongue to be disposed within the first groove of the first flexible curtain when the first flexible curtain is coupled to the second flexible curtain, a third inner surface of the third outer sheet and a fourth inner surface of the fourth outer sheet to extend beyond the first edge of the second insulation pad opposite the first edge of the first insulation pad such that the third and fourth inner surfaces of the respective third and fourth outer sheets extending beyond the first edge of the second insulation pad define a second groove, the first inner surface of the first outer sheet of the first groove to overlap the first outer surface of the third outer sheet of the tongue and the second inner surface of the second outer sheet of the first groove to overlap the second outer surface of the fourth outer sheet of the tongue when the first flexible curtain is coupled to the second flexible curtain.

2. The flame resistant room divider of claim 1, wherein the first groove of the first flexible curtain has a greater depth than the second groove of the second flexible curtain.

3. The flame resistant room divider of claim 1, wherein the first flexible curtain includes a sewn seam disposed along an outer perimeter of the first flexible curtain, the sewn seam connecting the first and second outer sheets to the first insulation pad.

4. The flame resistant room divider of claim 1, wherein the first insulation pad comprises an inorganic carbon fiber.

5. The flame resistant room divider of claim 1, wherein the first insulation pad is less dense than the first and second outer sheets.

6. The flame resistant room divider of claim 1, wherein both the second insulation pad and the third and fourth outer sheets extend into the first groove of the first flexible curtain.

7. The flame resistant room divider of claim 1, wherein the second flexible curtain includes a frayed edge disposed within the first groove of the first flexible curtain.

8. The flame resistant room divider of claim 1, wherein at least one of the first flexible curtain or the second flexible curtain is sufficiently flexible to restorably deflect in response to at least one of an impact or an air pressure differential provided between first and second sides of a wall defined by at least one of the first flexible curtain or the second flexible curtain.

9. The flame resistant room divider of claim 1, wherein the first and second outer sheets comprises a fiberglass fabric.

10. The flame resistant room divider of claim 9, wherein the first and second outer sheets comprises a silicone rubber coating.

11. The flame resistant room divider of claim 1, wherein the tongue being disposed within the first groove provides a tongue-and-groove joint between the first flexible curtain and the second flexible curtain, and further comprising a fastener extending through the tongue-and-groove joint to hold the first and second flexible curtains together.

12. The flame resistant room divider of claim 11, further comprising a grommet disposed adjacent the tongue-and-groove joint, wherein the fastener extends through the grommet.

13. A flame resistant room divider configured to be suspended from an overhead structure, the flame resistant room divider comprising:

a first flexible curtain configured to hang from the overhead structure, the first flexible curtain having a first side and a second side opposite the first side, the first flexible curtain having a first insulation pad disposed between a first pair of outer sheets, the first pair of outer sheets and a first edge of the insulation pad along the first side of the first flexible curtain to define a first connector, the first connector defined by being between at least a full thickness of each sheet of the first pair of outer sheets, the first pair of outer sheets comprising a flame resistant fiberglass fabric and the first insulation pad comprising an inorganic carbon fiber; and a second flexible curtain configured to hang from the overhead structure and being connected to the first flexible curtain, the second flexible curtain having a second insulation pad disposed between a second pair of outer sheets, the second pair of outer sheets comprising the flame resistant fiberglass fabric and the second insulation pad comprising the inorganic carbon fiber, the second pair of outer sheets extend beyond a second edge of the second insulation pad along a first side of the second flexible curtain to define a first groove between the second pair of outer sheets to couple the second flexible curtain and the first flexible curtain, the first groove defined by at least a full thickness of the second pair of outer sheets that extends past the edge of the second insulation pad, the first groove to receive the first connector of the first flexible curtain such that opposing inner surfaces defined by the second pair of sheets providing the first groove overlap opposing outer surfaces defined by the first pair of outer sheets when the first flexible curtain is coupled to the second flexible curtain.

14. The flame resistant room divider of claim 13, wherein the first and second flexible curtains are substantially identical.

15. The flame resistant room divider of claim 13, wherein the first flexible curtain includes a sewn seam disposed along an outer perimeter of the first flexible curtain, the sewn seam connecting the first pair of outer sheets to the first insulation pad.

16. The flame resistant room divider of claim 13, wherein the first pair of outer sheets extend beyond a second edge of the first insulation pad opposite the first edge and along the second side of the first flexible curtain to define a second groove between the first pair of outer sheets that extend past the second edge of the first insulation pad to receive a second connector of a third flexible curtain to couple the first flexible curtain and a third flexible curtain, and a second side of the second flexible curtain opposite the first side includes a third connector to be positioned in a third groove of a fourth flexible curtain to couple the fourth flexible curtain and the second flexible curtain.

17. The flame resistant room divider of claim 13, wherein both a portion of the first insulation pad and the outer surface of the first pair of outer sheets extend into the first groove of the second flexible curtain.

18. The flame resistant room divider of claim 13, wherein the first connector of the first flexible curtain includes a frayed edge to be disposed within the first groove of the second flexible curtain.

19. The flame resistant room divider of claim 13, wherein the first connector of the first flexible curtain comprises a tongue, the tongue being disposed within the first groove to provide a tongue-and-groove joint between the first flexible curtain and the second flexible curtain.

20. The flame resistant room divider of claim 13, wherein a lower end of the first flexible curtain is to be anchored to a floor and an upper end of the first flexible curtain is to be attached to a ceiling.

21. The flame resistant room divider of claim 13, further comprising a fastener to couple the first and second flexible curtains via the first connector.

22. The flame resistant room divider of claim 21, wherein the fastener extends through the first connector.

23. The flame resistant room divider of claim 13, wherein the first groove and portions of the second pair of sheets that extend past the first edge of the second insulation pad define a U-shaped opening.

24. The flame resistant room divider of claim 23, wherein the U-shaped opening is to receive the first connector defined by the first pair of outer sheets.

25. A flame resistant room divider suspended from an overhead structure, the flame resistant room divider comprising:

a first flexible curtain to hang from the overhead structure, the first flexible curtain having a first insulation pad disposed between a first pair of outer sheets, the first pair of outer sheets extend beyond a first edge of the insulation pad to define a first connector having a first groove between inner surfaces of the first pair of outer sheets and the first edge of the first insulation pad, the first groove defined by a full thickness of each sheet of the first pair of outer sheets that extends past the edge of the insulation pad, and the first pair of outer sheets and a second edge of the insulation pad opposite the first edge to define a first tongue; and a second flexible curtain to hang from the overhead structure and being connected to the first flexible curtain, the second flexible curtain having a second insulation pad disposed between a second pair of outer sheets, the second pair of outer sheets extend beyond a first edge of the second insulation pad to define a second connector having a second groove between inner surfaces of the second pair of outer sheets and the first edge of the second insulation pad, the second groove defined by at least a full thickness of the second pair of outer sheets that extends past the first edge of the second insulation pad, and the second pair of outer sheets and a second edge of the insulation pad opposite the first edge to define a second tongue, wherein the first connector of the first flexible curtain is to receive the second tongue of the second flexible curtain to couple the first and second flexible curtains, wherein the inner surfaces of the pair of the first sheets defined by the first connector are to engage outer surfaces of the second pair of sheets when the first flexible curtain is coupled to the second flexible curtain.

* * * * *